United States Patent [19]

Justus

[11] Patent Number: 4,844,283

[45] Date of Patent: Jul. 4, 1989

[54] CLOSURE MECHANISM FOR WIRE COATING OVEN

[75] Inventor: Paul E. Justus, Fort Wayne, Ind.

[73] Assignee: Essex Group, Inc., Fort Wayne, Ind.

[21] Appl. No.: 240,769

[22] Filed: Sep. 2, 1988

[51] Int. Cl.[4] ..... B65D 43/26

[52] U.S. Cl. ..... 220/264; 34/107; 98/40.17; 126/192

[58] Field of Search ..... 126/192, 193, 198; 98/40.17, 87; 34/107, 155, 227, 231; 220/263, 264, 331, 335, 337

[56] References Cited

U.S. PATENT DOCUMENTS

| | | | |
|---|---|---|---|
| 2,821,897 | 2/1958 | Kreuttner | 98/40.17 |
| 3,242,847 | 3/1966 | Averill et al. | 98/40.17 |
| 3,364,839 | 1/1968 | Sweeney et al. | 98/40.17 |
| 3,811,369 | 5/1974 | Ruegg | 98/40.17 |

FOREIGN PATENT DOCUMENTS

| | | | |
|---|---|---|---|
| 7603472 | 10/1977 | Netherlands | 90/40.17 |
| 1514459 | 6/1978 | United Kingdom | 90/40.17 |

*Primary Examiner*—Stephen Marcus
*Assistant Examiner*—Nova Stucker

[57] ABSTRACT

A closure mechanism (15) includes a pair of doors (25) biased in a closing direction and a cam (75) which symmetrically adjusts the position of the doors when drawn therethrough and asymmetrically adjusts the position of the doors when pivoted thereagainst.

6 Claims, 1 Drawing Sheet

CLOSURE MECHANISM FOR WIRE COATING OVEN

DESCRIPTION

1. Technical Field

This invention relates generally to wire coating ovens, and specifically to an improved closure mechanism for such ovens.

2. Background Art

In the manufacture of wire such as magnet wire, a metallic wire core is insulated by coating the core with such materials as enamels or resins which, in addition to insulating the wire, lend a measure of resistance to damage thereof during handling. To optimize the properties of the insulation, it is a common practice to insulate the wires with multiple coatings of various chemical compositions. For example, typical magnet wire may be provided with one or more layers of a polyester enamel base coat followed by one or more layers of amide-imide enamel top coats. These materials, normally suspended in a solvent or dispersing agent, are generally spray coated, meter dicoated, or applied by rollers. After the application of each coating layer, the wires are generally passed through a wire coating oven which may be provided with multiple cure zones for driving off the solvents or dispersing agents by evaporization and for polymerizing or otherwise curing the coating material. To achieve proper coating thickness, coating application, evaporation, curing, cooling and reapplication of coating materials are serially repeated.

Current closures for such wire coating ovens generally comprise a plate having a slot therein through which multiple wires pass as they are coated, cured and cooled in the serial manner set forth hereinabove. Typically, the plate is slidably retained on the oven so that the position of the slot is adjustable. However, since the slot is of fixed dimension, variation in the area of the slot to adjust airflow therethrough or to accommodate the various orientations of multiple wires or die bars or similar threading devices of various dimensions, is not attainable. Accordingly, the slot must be of a large enough area to accommodate such various wire orientations and threading devices. It will be appreciated that such accommodation is achieved by overdimensioning the slot. However, such overdimensioning of the slot provides a leakage path through the slot for heat produced by the oven as well as vaporized solvents and dispersing agents mentioned hereinabove. Clearly, such loss of oven heat through the slot can significantly detract from the efficiency of the oven, thereby substantially raising the cost of the wire coated therein while the leakage of solvents or dispersing agents can be injurious to the health of personnel operating the apparatus.

DISCLOSURE OF INVENTION

It is therefore an object of the present invention to provide an improved closure mechanism for a wire coating oven.

It is another object of the present invention to provide a closure mechanism for a wire coating oven which will automatically provide the minimum opening area necessary for accommodation of wires or threading devices such as die bars or the like, to reduce unwanted leakage of heat and vaporized chemical compounds from the oven.

It is a further object of the present invention to provide a closure mechanism for a wire coating oven wherein the size of the opening area and position thereof are easily adjustable.

These and other objects which will be come readily apparent from the following detailed description and appended claims, are achieved by a novel closure mechanism for a wire coating oven which includes first and second doors biased in a direction tending to close an opening into the oven, and of a geometry which allows the doors to be automatically opened by wires and, if applicable, threading devices passing therethrough. An operator disposed between the doors and engageable therewith, can simultaneously adjust the area of the opening between the doors as well as the lateral (with respect to the longitudinal axes of the wires) position thereof.

In the preferred embodiment, the doors are pivotably mounted on opposed sides of a frame and hang downwardly from the frame, being biased inwardly with respect thereto. Such biasing is achieved by counterweights carried by support flanges which may be formed integrally with the doors. The operator may comprise a cam which symmetrically opens and closes the doors as the cam is longitudinally moved therebetween. The cam also asymmetrically adjusts the position of the doors as the cam is pivoted thereagainst to laterally offset the position of the opening. The doors follow the movement of the cam due to the biasing of the doors against the cam by the counterweights.

BEST MODE FOR CARRYING OUT THE INVENTION AND INDUSTRIAL APPLICABILITY THEREOF

Figure 1:
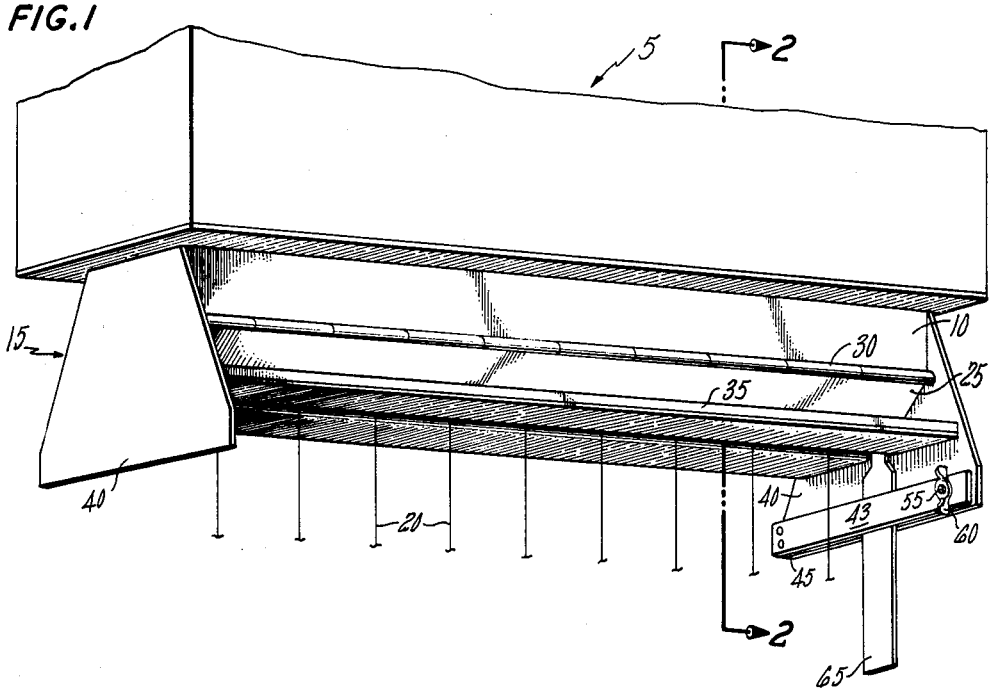
FIG. 1 is a perspective view of the closure mechanism of the present invention.

Referring to FIG. 1, the exit portion of a wire coating oven is shown at 5 and includes a frame 10 defining the bottom exit of the oven, the frame supporting the closure mechanism 15 of the present invention. For illustrative purposes, nine wires 20, threaded through die bars 23, (FIG. 2A) are simultaneously drawn through oven 5 to vaporize solvents or dispersing agents in the wires' insulative coating and to cure the remaining insulative material. The wire may be formed from any suitable material such as copper or aluminum, of any desired diameter, such as from AWG 12 (0.0808 in. diameter) through AWG 24 (0.0201 in. diameter). The wires may be insulated with any known insulation curable in oven 5 such as various types of enamel insulation, for example,,GP 200, MR 200, as well as various other known insulations.

Figure 2A:
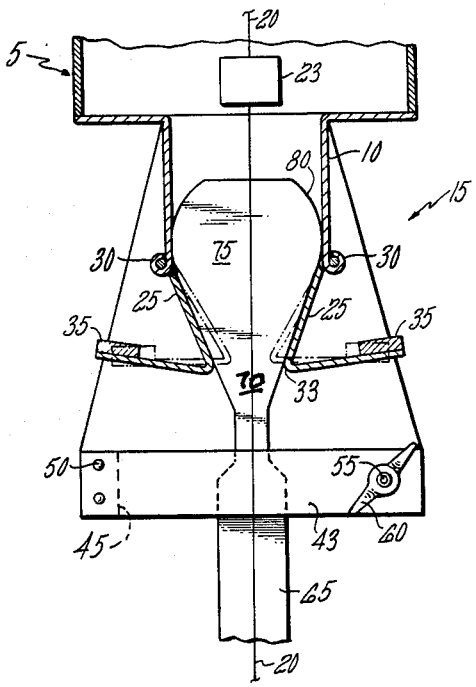
FIG. 2A is a sectional view of the closure mechanism of the present invention taken along line 2—2 of FIG. 1.
Figure 2B:
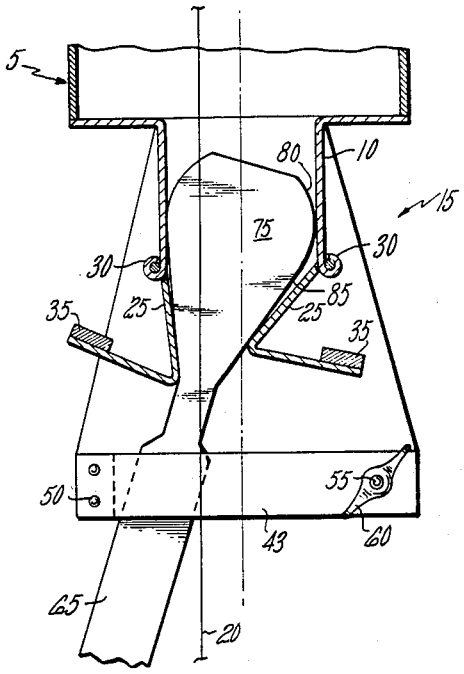
FIG. 2B is a sectional view taken along line 2—2 of FIG. 1 but showing the closure assembly as defining an opening which is laterally offset from to the centerline of the oven.

Closure mechanism 15 comprises a pair of doors 25 hinged at 30 to the lower free edges of frame 15. As best seen in FIGS. 2A and 2B, each door is generally channel-shaped of V cross-section, each channel being formed from a pair of integral flanges meeting along apex 33. The innermost (with respect to the wire) flanges functions to define the width and lateral position of an opening through the closure mechanism through which the wire exits the oven. The outer flanges function as carriers for counterweights 35, laterally offsetting the counterweights from apexes 30 such that each counterweight loads a corresponding door with a couple acting about hinge 30 to bias the door in a direction tending to close the door. The doors and frame may be formed from any suitable materials which will withstand the heat from the oven and the vaporized solvents and dispersing agents given off by the insulation cured within the oven.

The ends of the opening defined by the lower portion of frame 15 and the doors are covered by endplates 40. Endplates 40 may each be provided with an inner bar 43 riveted at one end thereof to the endplate through a spacer block 45 at 50. The opposite end of the bar may be drilled and removably fixed to the plate by a threaded stud 55 extending from an inner surface of the plate and a wing nut 60.

Endplate 40 and bar 43 define a slot therebetween which receives handle portion 65 of an operator 70 provided at the end thereof with cam 75. As best seen in FIGS. 2A and 2B, cam 75 includes a flat upper surface and two similarly lobed, opposed side surfaces 80 which fair into a pair of oblique side surfaces 85 the lower edges of which merge into handle 65. Cam 75 is, at the lobed portion thereof, of essentially the same width as the spacing between hinges 30 whereby the cam is supported from the lobes by its engagement with the interior of frame 10. Accordingly, it will be appreciated that due to the inward taper of the oblique surfaces 85, as the cam is raised from its position shown in FIG. 2A by manually raising handle 65 to decrease the area of the opening between the doors 25, the doors are allowed to move in a closing direction by the biasing couple provided by counterweights 35. Similarly, when handle 65 is lowered from the raised position, the taper provided by oblique surfaces 85 forces the doors apart to increase the furnace opening defined thereby.

Cam 75 also provides a convenient means for adjusting the lateral position of the opening defined by doors 25 if such an adjustment is so required. Thus, as seen in FIG. 2B, when handle 65 is pivoted in a clockwise direction from its position in FIG. 2A, the left hand door is pushed by the adjacent oblique surface in a clockwise direction opening that door while the right hand door is allowed to move in a closing direction under the influence of the corresponding counterweight due to a clockwise movement of the right hand oblique surface on cam 75. Accordingly, it will be seen that such movement of the doors effectively shifts the opening to the left. Likewise, if it is desired to shift the opening defined by the doors to the right, handle 65 is merely pivoted in a counterclockwise direction thereby causing the right hand door to move in an opening direction while allowing the left hand door to move in a closing direction under the influence of its own counterweight.

In the event that it is desired to adjust the size of the opening as well as the lateral position thereof, the handle may be moved upwardly or downwardly simultaneously with a pivoting thereof to effect such opening adjustment.

From the foregoing description, it is apparent that the closure mechanism of the present invention overcomes the disadvantages of prior art closures which, as set forth hereinabove, have comprised a movable plate with a slot provided therein. Since the doors are biased inwardly in a closing direction by the counterweights, the doors will always define the minimum required opening area to accommodate the wires and die bars drawn therethrough. Thus, leakage of heat and vaporized solvents or dispersing agents is minimized for enhanced curing, efficiency and safety of operating personnel. The cam operator provides a convenient means for simultaneously adjusting the size of the opening to adjust airflow therethrough as well as the lateral location thereof with a single easily manipulatable operator.

While a particular embodiment of the present invention has been illustrated and described, it will become readily apparent to those skilled in the art that various modifications may be made thereto without departing from the present invention. For example, while the closure mechanism has been shown as occupying a position at the lowermost furnace exit, it will be appreciated that this invention will serve with equal utility at an upper furnace entrance. While nine wires have been shown threaded through the furnace and closure mechanism, the invention herein is not limited to use with any particular number or arrangement of wires. Similarly, while the closure mechanism has been described in use with a coating oven for electrically conducting wires such as aluminum or copper wires, it will be readily apparent that this closure mechanism may be used with any processing apparatus for coating elongate bodies threaded therethrough. Accordingly, it is intended by the appended claims to cover these and any other modifications which fall within the true spirit and scope of the present invention.

Having thus described the invention, what is claimed is:

1. A closure mechanism for simultaneously adjusting the cross-sectional area and location of an opening in a wire coating oven or the like, said closure mechanism being characterized by:

first and second doors biased in a direction tending to close said opening; and an operator disposed between said doors and being engageable therewith for adjusting the position thereof;

said operator being movable in a first direction for symmetrically and simultaneously adjusting the position of said doors and therefore, the area of said opening without changing the location thereof;

said operator being further movable in a second direction to asymmetrically position said doors to adjust the position of said opening as well as the area thereof.

2. The closure mechanism of claim 1, said closure mechanism being further characterized by each of said doors including a counterweight which effects said biasing of said doors in said direction tending to close said opening.

3. The closure mechanism of claim 2, said closure mechanism being further characterized by each of said doors including an outwardly extending flange which carries said counterweight thereon.

4. The closure mechanism of claim 1, said closure mechanism being further characterized by:

a frame, said doors being pivotably mounted to opposed sides of said frame, said doors hanging downwardly from said frame and biased inwardly with respect thereof.

5. The closure mechanism of claim 4, said closure mechanism being further characterized by said operator comprising a cam including a pair of lobed surfaces which frictionally engage the interior of said frame to support said operator therewithin.

6. The closure mechanism of claim 1, said closure mechanism being further characterized by said cam comprising a pair of opposed oblique surfaces, each of which moves one of said doors for said symmetric positioning thereof as said cam is drawn longitudinally therepast and for said asymmetric positioning thereof as said cam is pivoted thereagainst.

* * * * *